US011406154B2

(12) United States Patent
Fina

(10) Patent No.: US 11,406,154 B2
(45) Date of Patent: Aug. 9, 2022

(54) SANDAL WITH DETACHABLE FOOTCOVER

(71) Applicant: Paul George Fina, Yorkvill, IL (US)

(72) Inventor: Paul George Fina, Yorkvill, IL (US)

( * ) Notice: Subject to any disclaimer, the term of this patent is extended or adjusted under 35 U.S.C. 154(b) by 110 days.

(21) Appl. No.: 17/120,238

(22) Filed: Dec. 13, 2020

(65) Prior Publication Data

US 2021/0195986 A1 Jul. 1, 2021

Related U.S. Application Data

(63) Continuation-in-part of application No. 16/726,869, filed on Dec. 25, 2019, now Pat. No. 10,925,344.

(51) Int. Cl.
*A43B 3/12* (2006.01)

(52) U.S. Cl.
CPC ..... *A43B 3/122* (2013.01)

(58) Field of Classification Search
CPC ..... A43B 3/24; A43B 3/242; A43B 3/244; A43B 3/246; A43B 3/248; A43B 3/12; A43B 3/122
USPC ..... 36/11.5, 15, 100, 101
See application file for complete search history.

(56) References Cited

U.S. PATENT DOCUMENTS 3,063,457 A * 11/1962 Bittner ..... A43B 7/145 D2/916
4,887,369 A * 12/1989 Bailey ..... A43B 3/24 36/15
6,581,255 B2 * 6/2003 Kay ..... A43B 3/122 24/640
10,925,344 B1 * 2/2021 Fina ..... A43B 3/126
2002/0194750 A1 * 12/2002 Feick ..... A43C 11/06 36/11.5
2003/0145490 A1 * 8/2003 Tsai ..... A43B 3/122 36/15
2004/0064976 A1 * 4/2004 Barteet ..... A43B 3/103 36/100
2004/0187346 A1 * 9/2004 Bianchi ..... A43B 3/244 36/24
2005/0262738 A1 * 12/2005 Gerber ..... A43B 3/105 36/101
2007/0101619 A1 * 5/2007 Bensing ..... A43B 1/0072 36/136
2007/0240336 A1 * 10/2007 Richardson ..... A43B 3/244 36/15
2007/0266506 A1 * 11/2007 Barteet ..... A43B 3/103 12/128 R
2010/0083533 A1 * 4/2010 Terner ..... A43D 999/00 36/43

(Continued)

*Primary Examiner* — Marie D Bays

(57) ABSTRACT

Provided is a sandal, which includes a base, where the base has a top surface upon which a human foot rests and a periphery defining a peripheral heel end, a peripheral toe end, a longitudinal extent measured from the heel end to the toe end, and first and second opposed peripheral sides. Further, the first peripheral side has at least one base attachment and the second peripheral side having at least one base attachment. The sandal also includes a foot cover which is selectively detachable from the base, such that the cover includes at least one cover attachment which receives the at least one base attachment on the first peripheral side, and at least one cover attachment which receives the at least base attachment on the second peripheral side.

20 Claims, 15 Drawing Sheets

(56) References Cited

U.S. PATENT DOCUMENTS

| | | | | |
|---|---|---|---|---|
| 2013/0255106 | A1* | 10/2013 | Cho | A43B 3/244<br>36/100 |
| 2014/0208611 | A1* | 7/2014 | de Leon | A43B 13/18<br>36/28 |
| 2014/0250734 | A1* | 9/2014 | Zheng | A43B 1/02<br>12/142 R |
| 2015/0351486 | A1* | 12/2015 | Opiyo | A43B 1/0027<br>36/101 |
| 2020/0008515 | A1* | 1/2020 | Pellegrino | A43B 3/0078 |

* cited by examiner

SANDAL WITH DETACHABLE FOOTCOVER

CROSS REFERENCE TO RELATED APPLICATIONS

The present application is a continuation in part of application Ser. No. 16/726,869 filed on Dec. 25, 2019, entitled "Sandal with Detachable Foot Cover," which is currently pending, which is incorporated herein by reference in its entirety.

REFERENCE REGARDING FEDERALLY SPONSORED RESEARCH OR DEVELOPMENT

Not applicable.

SEQUENTIAL LISTING

Not applicable

TECHNICAL FIELD

The present disclosure relates to sandals, also known as slides, and more specifically to sandals or slides with removable foot covers.

BACKGROUND

Shoes have been in use for thousands of years to protect the human foot from the ground, to keep the foot warm, dry, or otherwise protected from the elements. Shoe designers, including designers of sandals or slides, continually look for ways to enhance the appeal of shoes to consumers from a functional and/or aesthetic purpose. However, available sandals or slides, have significant shortcomings. First, most sandals have foot covers that are permanently attached to the base. Such permanent attachment prevents interchanging designs or images on the foot cover. Moreover, when the foot cover wears down, it cannot be replaced, and the whole sandal must be discarded. Most sandals that do include custom designs or images on the foot covers are expensive, preventing consumers from being able to purchase many different pair of sandals. Moreover, the available sandals or slides, that do include interchangeable foot covers are difficult to use, as they typically either contain many different components and are thus difficult to assemble or are susceptible to breaking. Also, applying increased force to the foot cover of available sandals usually causes the connection between the foot cover and base to fail. Additionally, with other available interchangeable foot covers, achieving a comfortable fit is difficult. Therefore, there is a need for a sandal or slide that allows interchangeable foot covers with unique designs or images that is inexpensive and easy to assemble, as well as having a comfortable fit and a strong connection between the foot cover and base.

SUMMARY

The present disclosure addresses the above-listed problems of conventional sandals, which are also known as slides. An important feature of the present disclosure is the ability to interchange the foot cover of the present sandal or slide. Therefore, the consumer can buy as many pairs of foot covers as they like and only need one pair of bases. Accordingly, with the one pair of bases, each pair of foot covers acts as a separate pair of sandals for fashion purposes. Moreover, the foot covers can display unique designs or images. By having interchangeability and customization, consumers have greater design freedom with their sandals. For example, a user optionally substitutes different colors of foot covers so as to match different colored clothing. Alternatively, a user optionally changes a solid color foot cover to a foot cover having a desired seasonal or holiday images, such as a Christmas tree, a snowman or pumpkins.

Having the ability to interchange the foot covers, and thus avoiding the purchase of multiple pairs of bases, provides the consumer with many different unique designs at less expense than if he or she needed to buy sandals that lack interchangeable foot covers. Additional expense is saved by being able to replace the foot covers. Foot covers are typically the first portion of the sandal to wear down. Therefore, by replacing the foot cover, the base can still be used.

Moreover, the present disclosure provides an easy to use assembly method. The present sandal features a base with laterally projecting pins that engage tapered openings in the corresponding foot cover(s). By placing the pins through a larger portion of the tapered openings and pressing the pins to the bottom of the tapered opening, the sandal is completely assembled. The present method provides an interchangeable foot cover that is easy to assemble and has a strong connection. The present method also facilitates a secure connection by having the pin press against a bottom or narrowed portion of the tapered opening. As the pin presses against the bottom of the tapered opening, the connection is made more secure, facilitating a more reliable connection, while preventing the connection from breaking and potentially injuring the wearer.

An alternate attachment mechanism for the present sandal features a base with base attachments which engage corresponding cover attachments of the foot cover(s). By placing the cover attachments between the arms of the base attachments and sliding the cover attachments such that the rear wall of the cover attachments is in contact with the front face of the shaft of the base attachments, the sandal is completely assembled. This alternate assembly also provides an interchangeable foot cover that is easy to assemble and has a strong connection. Specifically, when assembled, the tabs of the cover attachments press against the indents of the base attachment shaft. This, in combination with the contact between the front face of the shaft, and the rear wall of the cover attachment, create a secure connection. As the foot of the wearer presses against the foot cover, the base and cover attachments are pressed against one another, facilitating a reliable connection. This alternate attachment mechanism of the present method also provides an interchangeable foot cover that is easy to assemble and has a strong connection.

Furthermore, the present sandal or slide requires few components, so it is relatively simple and inexpensive to manufacture. Additionally, finding a comfortable fit is facilitated by being able to use different foot covers. The consumer optionally tries different size foot covers until he or she finds the size that best matches his or her feet, improving wearer comfort.

These, as well as other aspects, advantages, and alternatives, will become apparent to those of ordinary skill in the art by reading the following detailed description, with reference where appropriate to the accompanying drawings.

The present disclosure includes a sandal, also known as a slide, having a base and a foot cover. Further, the base has a top surface upon which a human foot rests, a periphery defined by a peripheral heel end and a peripheral toe end, and a longitudinal extent measured from the peripheral heel end to the peripheral toe end. On the periphery, there are first and second opposed peripheral sides, the first peripheral side having at least one pin and the second peripheral side having at least one pin. Moreover, the foot cover, which is selectively detachable from the base, has at least one tapered opening for receipt of the at least one pin on the first peripheral side, and at least one tapered opening for receipt of the at least one pin on the second peripheral side. In different embodiments, the tapered openings of the foot cover are either througholes, keyhole shaped, or defined by recessed surfaces in the foot cover. Alternatively, in one embodiment, the recessed surface forms one of the six sides of a receptacle, the receptacle housing the pins from the base.

The base has at least one pin which extends outwardly beyond its periphery on both peripheral sides, and in one embodiment, the first peripheral side includes a pair of the pins which define a first distance therebetween and the second peripheral side includes a pair of the pins which define a distance therebetween, such that the first distance is different from the second distance. The first distance is preferably either 1.54±0.5 inches (39.1±12.7 mm), 1.14±0.5 inches (29.0±12.7 mm), or 1.94±0.5 inches (49.3±12.7 mm). Similarly, the second distance is preferably either 1.91±0.5 inches (48.5±12.7 mm), 1.51±0.5 inches (38.4±12.7 mm), or 2.31±0.5 inches (58.7±12.7 mm). Additionally, in yet another embodiment, one of the pair of pins on the first peripheral side is spaced a greater distance from the top surface of the base than the other of the pair of pins proximate the first peripheral side. In an alternate embodiment, the foot cover has a first and a second layer, such that the second layer is a cushioning material and the first layer is an image layer. Alternative embodiments include, end caps which capture the first and second layers of the foot cover and a foot cover which is preferably transparent.

The selectively detachable foot cover includes a planar surface with a first terminal edge and a second terminal edge, a body, and a main planar surface of the body which extends between the first and second terminal edges. Additionally, the foot cover has at least one tapered opening defined proximate the first terminal edge, and at least one tapered opening defined proximate the second terminal edge. Alternate embodiments include tapered openings of the foot cover which are either throughholes or keyhole shaped. Additional embodiments have tapered openings defined by recessed surfaces in the foot cover, with these tapered openings alternatively defining one side of a receptacle configured for receiving pins. In one embodiment, the foot cover includes a pair of tapered openings proximate the first terminal edge which define a first distance therebetween, and a pair of tapered openings proximate the second terminal edge which define a second distance therebetween, such that the first distance is different from the second distance. The first distance is preferably either 1.54±0.5 inches (39.1±12.7 mm), 1.14±0.5 inches (29.0±12.7 mm), or 1.94±0.5 inches (49.3±12.7 mm). Similarly, the second distance is preferably either 1.91±0.5 inches (48.5±12.7 mm), 1.51±0.5 inches (38.4±12.7 mm), or 2.31±0.5 inches (58.7±12.7 mm). In a further embodiment, one of the pair of tapered openings proximate the first terminal edge is spaced a greater distance from the first terminal edge than the other of the pair of the tapered openings proximate the first terminal edge. Included, in another embodiment, is a foot cover which is transparent. Additional embodiments include, the foot cover which has a first and second layer, where the second layer is a cushioning material and the first layer is an image layer, and end caps which capture the first and second layers.

A second embodiment of the present disclosure includes a sandal, also known as a slide, having a base and a foot cover. Further, the base has a top surface upon which a human foot rests, a periphery defined by a peripheral heel end and a peripheral toe end, and a longitudinal extent measured from the peripheral heel end to the peripheral toe end. On the periphery, there are first and second opposed peripheral sides, the first peripheral side having at least one base attachment and the second peripheral side having at least one base attachment. Moreover, the foot cover which includes a planar surface with a first terminal edge and a second terminal edge, is selectively detachable from the base, and has at least one cover attachment for receipt of the at least one base attachment on the first peripheral side, and at least one cover attachment for receipt of the at least one base attachment on the second peripheral side. Preferably, the base attachment extends outwardly beyond the periphery of the base. In an example embodiment a body of the foot cover is transparent.

In one embodiment the first peripheral side includes a pair of the base attachments and the second peripheral side includes a pair of the base attachments. In this embodiment, the pair of base attachments on the first peripheral side define a first distance therebetween, and the pair of the base attachments on the second peripheral side define a second distance therebetween, such that the first distance is different from the second distance. The first distance is preferably either 1.54±0.5 inches (39.1±12.7 mm), 1.14±0.5 inches (29.0±12.7 mm), or 1.94±0.5 inches (49.3±12.7 mm). Similarly, the second distance is preferably either 1.91±0.5 inches (48.5±12.7 mm), 1.51±0.5 inches (38.4±12.7 mm), or 2.31±0.5 inches (58.7±1.2.7 mm). Moreover, in yet another embodiment, one of the pair of the base attachments on the first peripheral side is spaced a greater distance from the top surface of the base than the other of the pair of the base attachments on the first peripheral side. Further, in another embodiment, the foot cover further includes a first layer and a second layer, such that the second layer includes a cushioning material and the first layer includes an image layer, where the image layer is exterior to the cushioning layer.

In a preferred embodiment, the cover attachment includes a rear wall which runs substantially parallel to the first or second terminal edge, two legs extending substantially perpendicularly from the rear wall on opposing lateral sides of the cover attachment; and two tabs extending from the cover attachment and the rear wall, such that the tabs are not in contact with the foot cover. Moreover, in another embodiment, the base attachment includes a rear portion which extends along the width of the base attachment, two arms which extend substantially perpendicularly to the rear portion, such that the arms form opposed sides of the base attachment, and a shaft extending from a central region of the rear portion, the shaft including a front face which contacts a rear wall of the cover attachments. In a further embodiment, the shaft further includes two indents separated by a post.

A further embodiment includes a pair of base attachments, such that one of the base attachments has arms, which extend further than the other of the pair of base attachments. An additional embodiment of the foot cover includes a pair of the cover attachments on the first terminal edge which define a first distance therebetween, and a pair of the cover attachments on the second terminal edge which define a second distance therebetween, such that the first distance is different from the second distance. Other embodiments which include a pair of base attachments and a pair of cover attachments, such that the pair of base attachments are configured to be a single component, and the pair of cover attachments are configured to be a single component.

The selectively detachable foot cover includes a planar surface with a first terminal edge and a second terminal edge, a body, and a main planar surface of the body which extends between the first and second terminal edges. Moreover, the foot cover has at least one cover attachment defined proximate the first terminal edge; and at least one cover attachment defined proximate to the second terminal edge. In alternate embodiments, the foot cover includes a pair of cover attachments proximate the first terminal edge and a pair of cover attachments proximate the second terminal edge. Preferably, the pair of cover attachments proximate the first terminal edge defines a first distance therebetween, and the pair of cover attachments proximate the second terminal edge define a second distance therebetween, such that the first distance is different from the second distance. The first distance is preferably either 1.54±0.5 inches (39.1±12.7 mm), 1.14±0.5 inches (29.0±12.7 mm), or 1.94±0.5 inches (49.3±12.7 mm). Similarly, the second distance is preferably either 1.91±0.5 inches (48.5±12.7 mm), 1.51±0.5 inches (38.4±12.7 mm), or 2.31±0.5 inches (58.7±12.7 mm). In yet another embodiment, one of the pair of cover attachments proximate the first terminal edge is spaced a greater distance from the first terminal edge than the other of the pair of the cover attachments proximate the first terminal edge. Alternatively, the foot cover includes first and second layers, such that the second layer includes a cushioning material and the first layer includes an image layer. In this embodiment, the first layer is exterior to the second layer. In another embodiment the body of the foot cover is transparent.

DETAILED DESCRIPTION

Figure 1A:
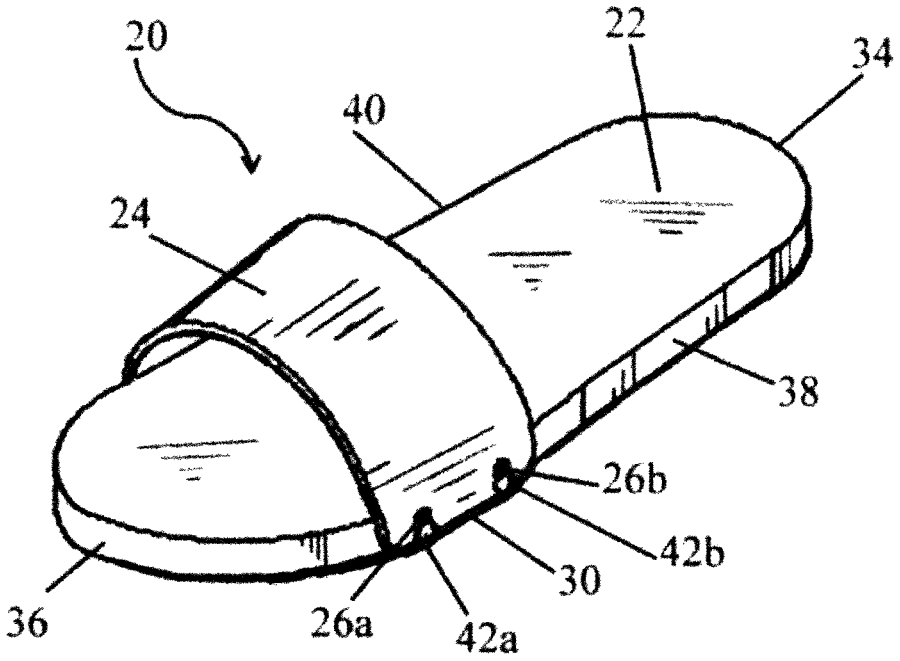
FIG. 1*a* depicts an example article of footwear, a sandal or slide, having an interchangeable cover, according to an example embodiment.
Figure 1B:
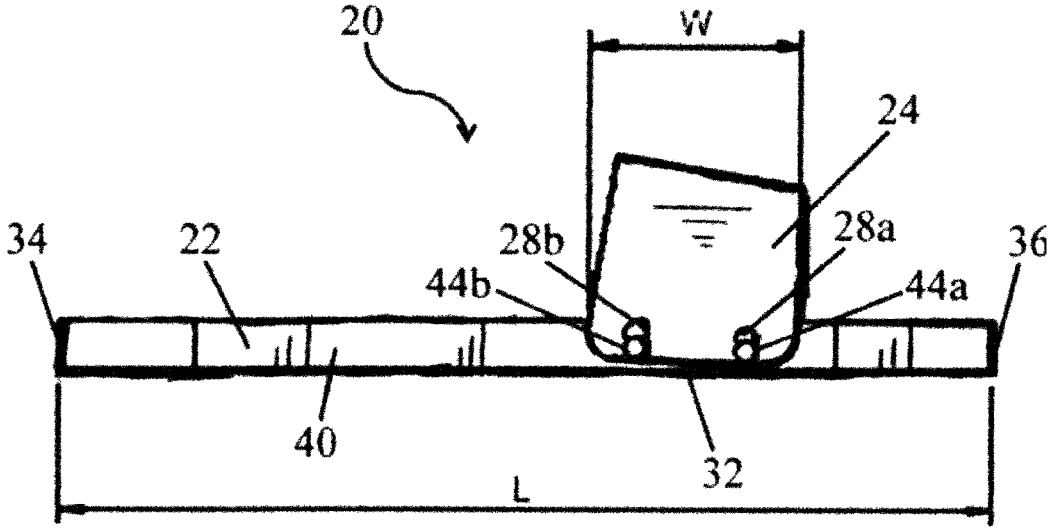
FIG. 1*b* depicts a side view of the sandal or slide of FIG. 1*a*, according to an example embodiment.
Figure 1C:
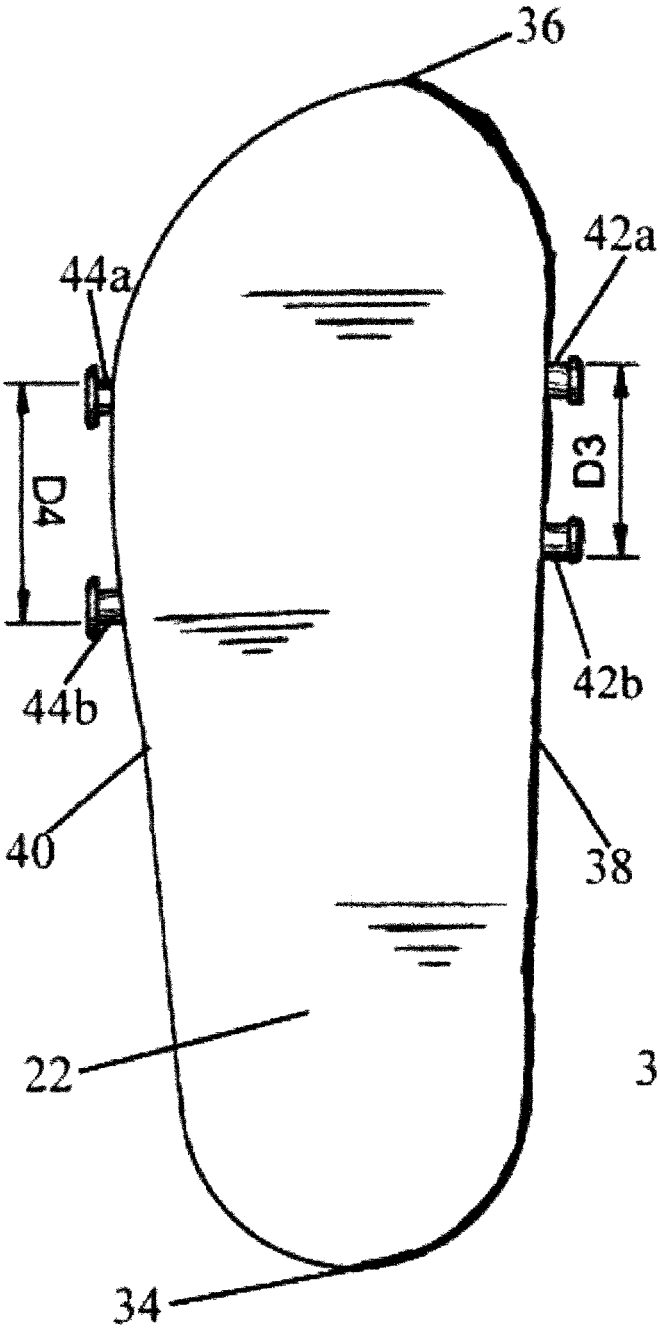
FIG. 1*c* depicts a base separate from a foot cover, according to an example embodiment.
Figure 1D:
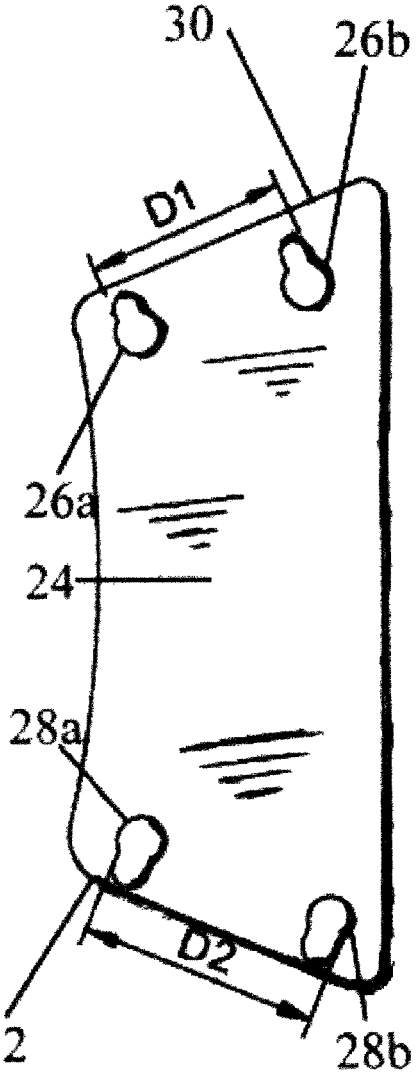
FIG. 1*d* depicts the foot cover separate from the base, according to an example embodiment.
Figure 3A:
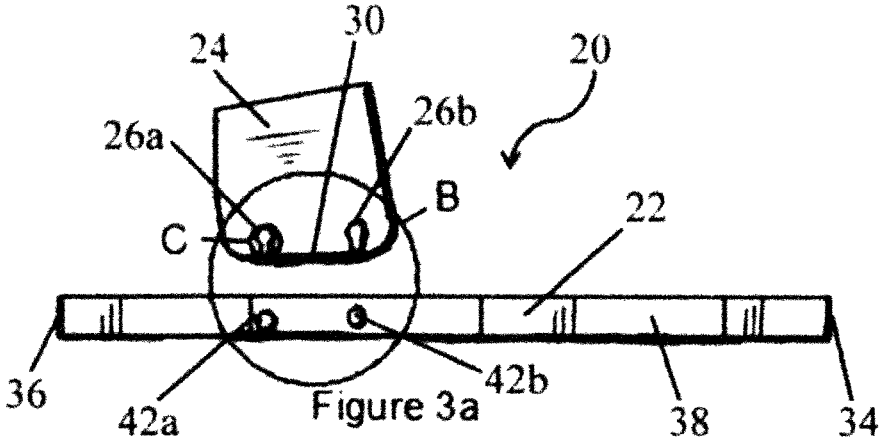
FIG. 3*a* depicts an exploded side view of the sandal or slide of FIG. 1*a*, according to an example embodiment.

Referring to FIG. 1*a*, FIG. 1*c*, and FIG. 1*d*, a sandal or slide 20 has a base 22, and a foot cover 24 which is selectively removable from the base 22 as shown in FIG. 3*a*. As displayed in FIG. 1*d*, the foot cover 24 includes at least one tapered opening 26*a*, 26*b* which preferably have a keyhole shape. FIG. 1*b* shows a longitudinal extent "L" defined between a heel end 34, and a toe end 36. The foot cover 24 includes a depth dimension "W" measured along the longitudinal extent L. FIG. 1*d* shows a terminal edge 30 of the foot cover 24 which includes at least one tapered opening 26*a*, 26*b*. Similarly, a terminal edge 32 opposite the terminal edge 30 includes at least one tapered opening 28*a*, 28*b*.

Referring to FIG. 1*c*, the base 22 has peripheral sides 38, 40. The peripheral side 38 includes at least one pin, and in a particular embodiment, a pair of pins 42*a*, 42*b*. Similarly, the peripheral side 40 includes at least one pin 44*a*, 44*b*. Each pin 42*a*, 42*b*, 44*a*, 44*b* preferably has an elongated shaft 45 and a radially enlarged head 45*a*. Thus, in one embodiment, the pins 42*a*, 42*b*, 44*a*, 44*b* resemble conventional nails. However, other configurations of the pins 42*a*, 42*b*, 44*a*, 44*b* are contemplated as are known in the art. FIG. 1*d* shows the foot cover 24, with a distance D1 defined between the tapered openings 26*a*, 26*b*, and a distance D2 defined between the tapered openings 28*a*, 28*b*. Moreover, FIG. 1*c* shows the base 22, with a distance D3 defined between pins 42*a*, 42*b* and a distance D4 defined between pins 44*a*, 44*b*. D1 is preferably equal to D3 so that the pins 42*a*, 42*b* are engaged with the respective tapered openings 26*a*, 26*b*. Similarly, D2 is preferably equal to D4, so that the pins 44*a*, 44*b* are engaged with the respective openings 28*a*, 28*b*. The base 22 is preferably made of a flexible PVC or rubber-like material, or other suitable material known to those in the art.

Figure 3B:
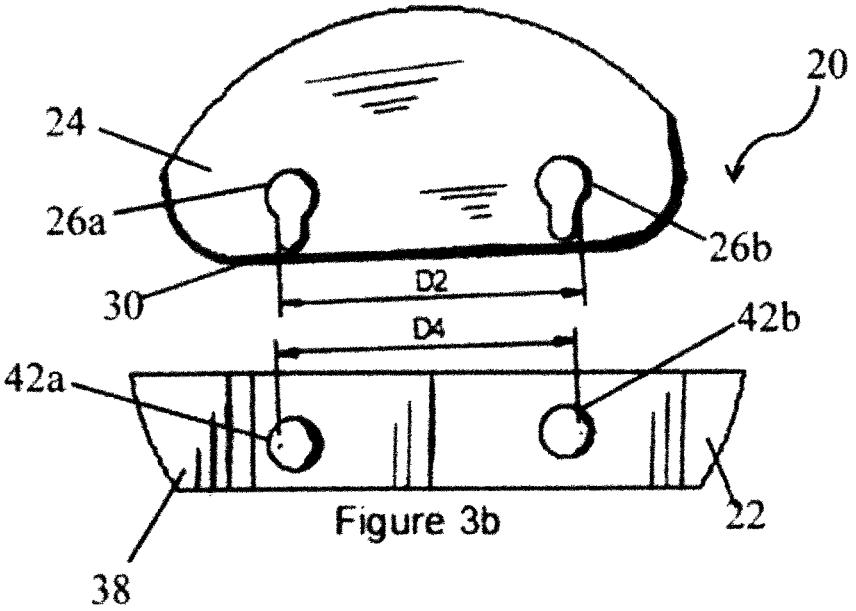
FIG. 3*b* depicts an enlarged view of the foot cover and the base from the foot cover of FIG. 3*a*, according to an example embodiment.
Figure 3C:
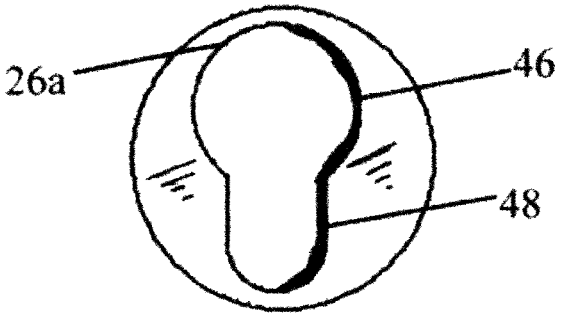
FIG. 3*c* depicts an enlarged tapered opening having a keyhole shape of FIG. 3*a*, according to an example embodiment.

Referring to FIG. 3*a* the sandal or slide 20, is disassembled into its components, the base 22 and the foot cover 24. FIG. 3*b* shows an enlarged view of the pins 42*a*, 42*b*, and the tapered openings 26*a*, 26*b*, from FIG. 3*a*. FIG. 3*c* shows an enlarged view of the tapered opening 26*a*, having a large portion 46 and a relatively narrow portion 48. In the preferred embodiment, the two portions 46, 48 are in communication with each other. Also, in the preferred embodiment, the large portion 46 is preferably semi-circular, and the narrow portion 48 is generally "U"-shaped. Other configurations of the tapered openings 28*a*, 28*b* are contemplated as are known in the art.

Figure 2A:
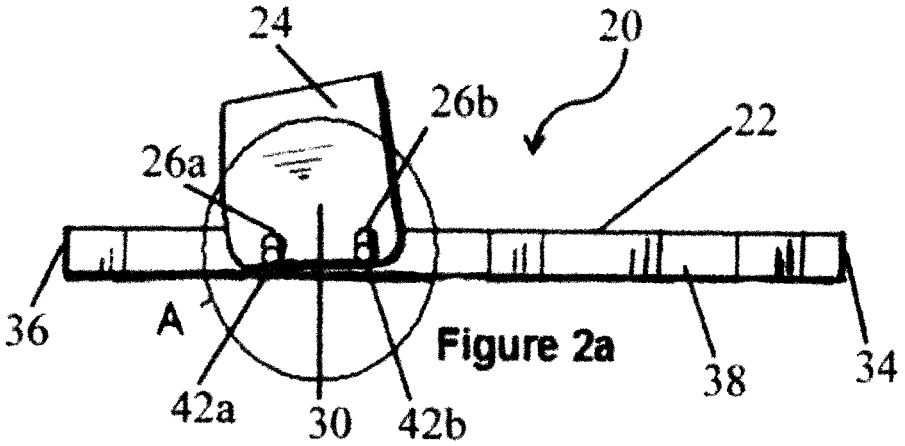
FIG. 2*a* depicts a side view of the sandal or slide of FIG. 1*a*, according to an example embodiment.
Figure 2B:
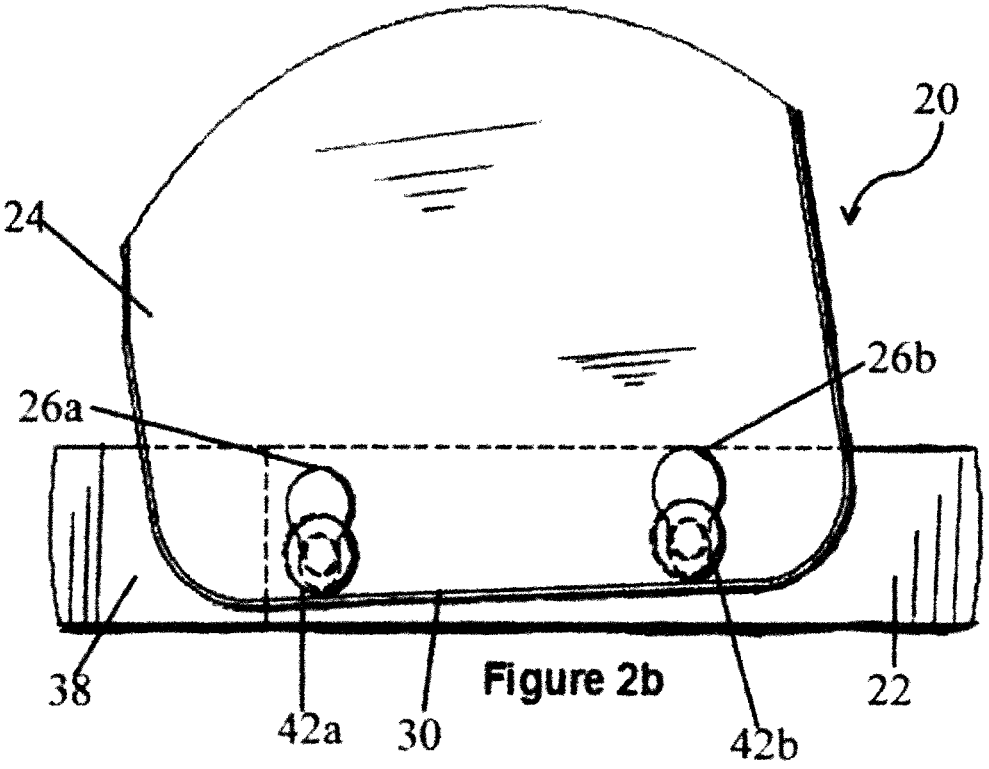
FIG. 2*b* depicts an enlarged example affixation of the foot cover to the base of FIG. 2*a*, according to an example embodiment.

Referring to FIG. 2*b*, the tapered openings 26*a*, 26*b* preferably have a keyhole shape to facilitate insertion of the pins 42*a*, 42*b*. A method for applying the foot cover 24 to the base 22 involves placing the pins 42*a*, 42*b*, 44*a*, 44*b* into the large portion 46 of the corresponding tapered openings 26*a*, 26*b*, 28*a*, 28*b* and moving the foot cover 24 so that the pins 42*a*, 42*b*, 44*a*, 44*b* are in contact with the bottom of the narrow portion 48 of the tapered openings 26*a*, 26*b*, 28*a*, 28*b*. Then, as the foot of the wearer pushes up on the foot cover 24, the pins 42*a*, 42*b*, 44*a*, 44*b* push against the bottom of the tapered openings 26*a*, 26*b*, 28*a*, 28*b* facilitating a more secure connection.

Figure 4A:
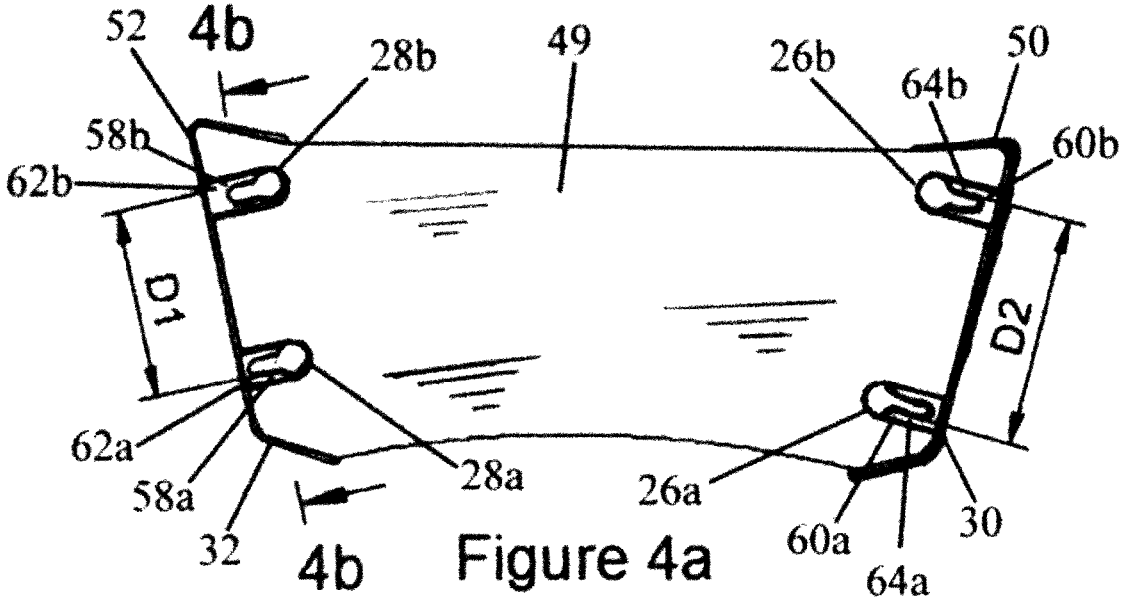
FIG. 4*a* depicts an example foot cover with end caps, according to an example embodiment.
Figure 4B:
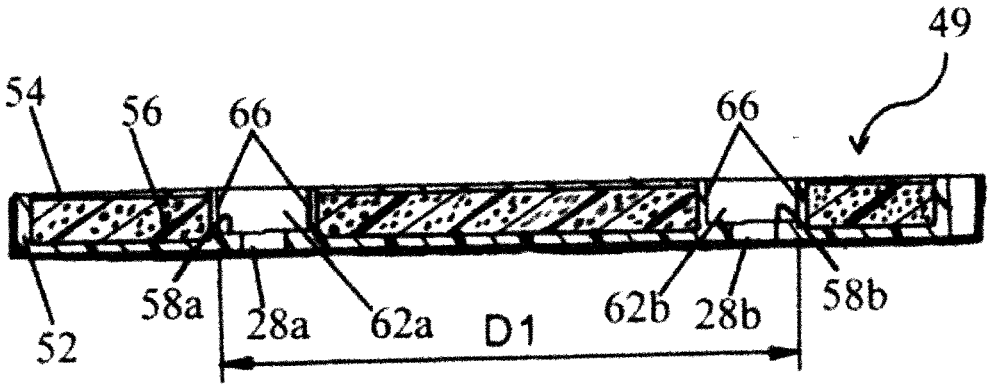
FIG. 4*b* is a cross-section taken along the line 4*b*-4*b* and in the direction generally indicted from arrows of FIG. 4*a*.

Referring to FIG. 4*a* and FIG. 4*b*, an alternate embodiment of the foot cover 24 is generally designated 49. Components shared with the foot cover 24 are designated with identical reference numbers. Important distinguishing features of the foot cover 49 include the presence of end caps 50, 52, a cushioning layer 54, and/or an image layer 56. As illustrated by FIG. 4*b*, the end cap 52 has recessed surfaces 58*a*, 58*b* proximate the terminal edge 32. Similarly, the end cap 50 has recessed surfaces 60*a*, 60*b* proximate the terminal edge 30. The recessed surfaces 58*a*, 58*b*, 60*a*, 60*b* are preferably recessed relative to the image layer 56 which is on an exterior of the foot cover 49. Inside the recessed surfaces 58*a*, 58*b* are the tapered openings 28*a*, 28*b* and inside the recessed surfaces 60*a*, 60*b* are the tapered openings 26*a*, 26*b*. Moreover, cavities 62*a*, 62*b*, Ma, 64*b* which are defined by the recessed surfaces 58*a*, 58*b*, 60*a*, 60*b*, respectively, also include sidewalls 66. In a preferred embodiment, the cavities 62*a*, 62*b*, 64*a*, 64*b* form a rectangular prism between sidewalls 66, such that the enlarged radial heads 45*a* of the pins 42*a*, 42*b*, 44*a*, 44*b* are located within the cavities 62*a*, 62*b*, 64*a*, 64*b* when the slide 20 is assembled. However, other shapes of the cavities 62*a*, 62*b*, 64*a*, 64*b* are contemplated as are known in the art. Additionally, the sidewalls 66 may be either flat or curved, in forming the cavities 62*a*, 62*b*, 64*a*, 64*b*.

Figure 5A:
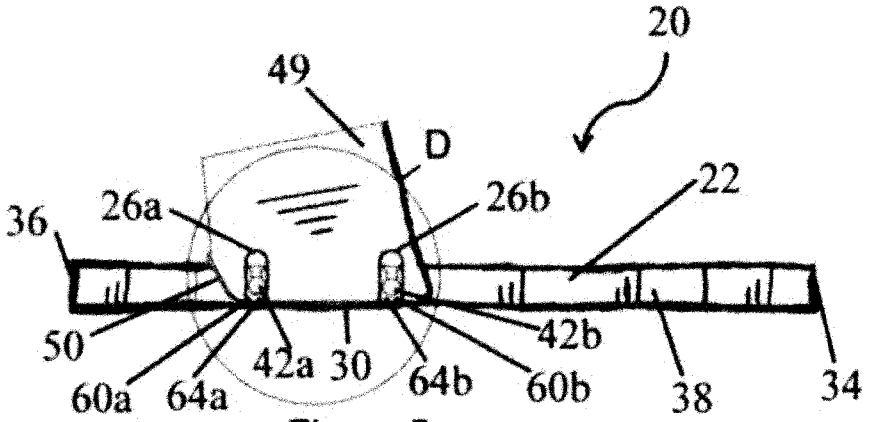
FIG. 5*a* depicts a side view of a sandal or slide with the foot cover with end caps of FIG. 4*a*, according to an example embodiment.
Figure 5B:
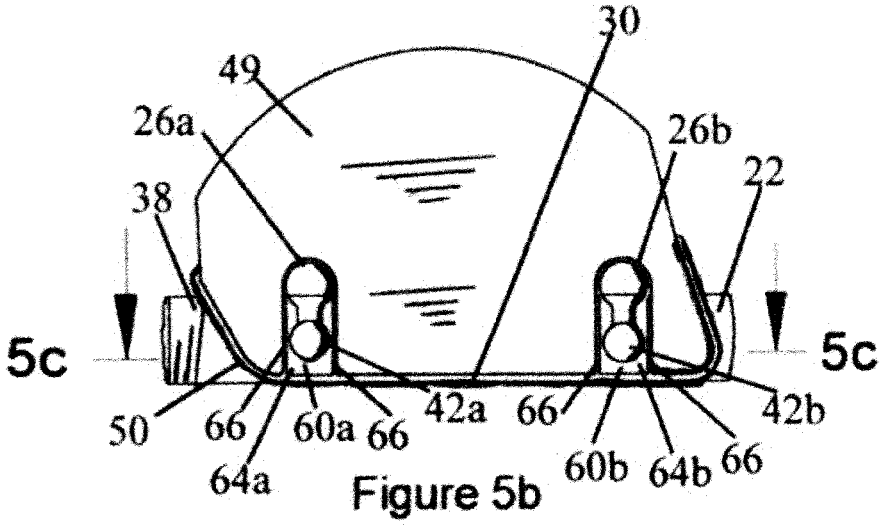
FIG. 5*b* depicts an enlarged example affixation of the foot cover with caps to the base of FIG. 5*a*, according to an example embodiment.
Figure 5C:
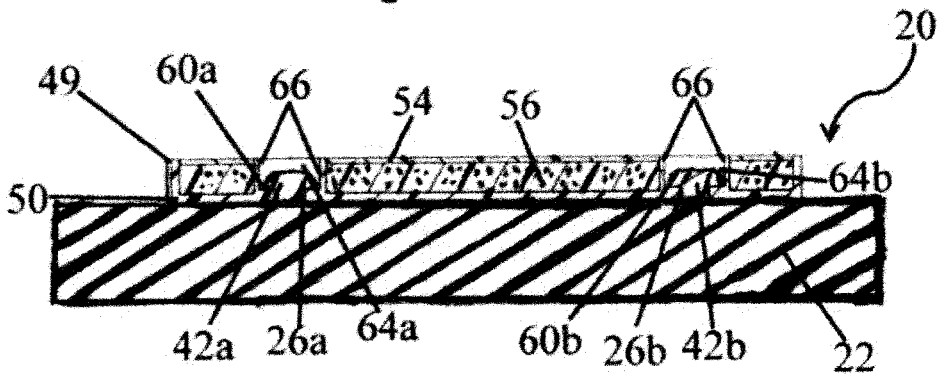
FIG. 5*c* is a cross-section taken along the line 5*c*-5*c* and in the direction generally indicted from arrows of FIG. 5*b*.

Referring to FIG. 5*a*, the sandal or slide 20 has the base 22 and the alternate foot cover 49 which is selectively removable from the base 22. FIG. 5*b* shows an enlarged view of the pins 42*a*, 42*b* residing in the cavities 64*a*, 64*b*, formed by the recessed surfaces 60*a*, 60*b*, and the sidewalls 66. As illustrated by FIG. 5*c*, the pins 42*a*, 42*b* fit within the cavities 64*a*, 64*b*. The bottom surface of enlarged radial heads 45*a* of the pins 42*a*, 42*b* preferably pushes against the recessed surfaces 60*a*, 60*b* to secure the alternate foot cover 49. If the pins 42*a*, 42*b* are in contact with the recessed surfaces 60*a*, 60*b*, the pressure they provide maintains the alternate foot cover 49 securely fastened to the base 22. Each of the cavities 64*a*, 64*b* are ideally large enough so that the enlarged radial heads 45*a* of the pins 42*a*, 42*b* have sufficient room such that they do not contact the side walls 66 when assembling or disassembling the slide 20.

Figure 5D:
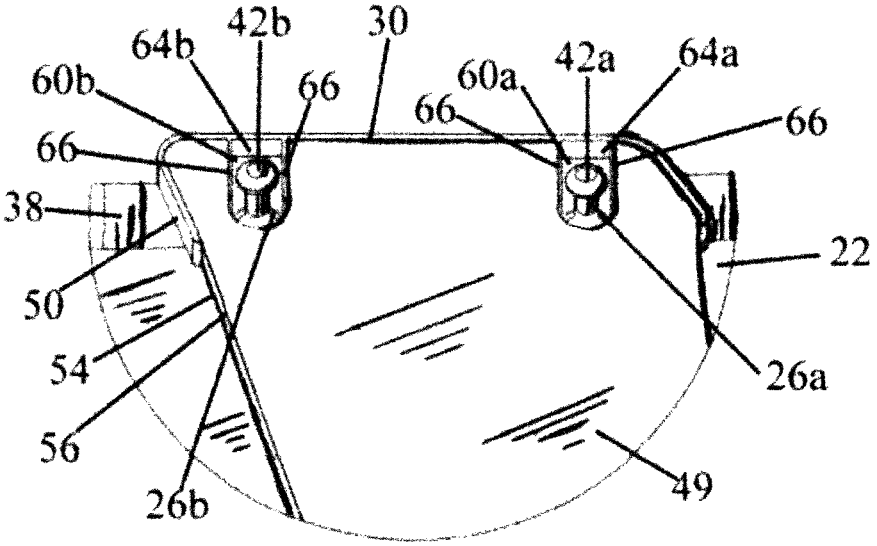
FIG. 5*d* depicts a side view of the slide of FIG. 5*a* rotated at a forty-five-degree angle, according to an example embodiment.

FIG. 5*d* shows an angled view of the interface between the alternate foot cover 49 and the base 22. Specifically, this view illustrates that within a preferred embodiment, the cavities 64*a*, 64*b* have a rectangular prism shape formed by the sidewalls 66 and the recessed surfaces 60*a*, 60*b*. The pins 42*a*, 42*b* are dimensioned relative to the corresponding cavities 64*a*, 64*b* and openings 26*a*, 26*b* so that they are allowed to slide from the large portion 46 to the narrow portion 48 of the tapered openings 26*a*, 26*b* until they are secure at the bottom of the tapered openings 26*a*, 26*b*. With the pins 42*a*, 42*b* pressing against the recessed surfaces 60*a*, 60*b*, and the bottom of the tapered openings 26*a*, 26*b*, the alternate foot cover 49 has a secure connection with the base 22 of the slide 20.

As illustrated by FIG. 5*a*-5*d*, by placing each of the tapered openings 26*a*, 26*b* in the recessed surfaces 58*a*, 58*b*, the enlarged radial heads 45*a* of the pins 44*a*, 44*b* preferably do not extend past the alternate foot cover 49 in the fully assembled slide 20. This is primarily because the recessed surfaces 58*a*, 58*b*, are sufficiently recessed from the image layer 56. The end caps 50, 52 are preferably made of hard plastic, epoxy resin, or other suitable material known to those in the art. Further, the cushioning layer 54 is preferably made of a durable, flexible material that is more soft and flexible than the end caps 50, 52. Finally, the image layer 56, is made of a material, such as but not limited to, synthetic paper with laser printing or sublimation on sublimation compatible materials, to allow unique designs and logos to be transferred onto the top of the alternate foot cover 49. Contemplated are other materials and methods for creating the alternate foot cover 49 as are known in the art. Also contemplated is a transparent foot cover 68 has no image layer 56 and has only a transparent cushioning layer 70, and end caps 50, 52.

Figure 6A:
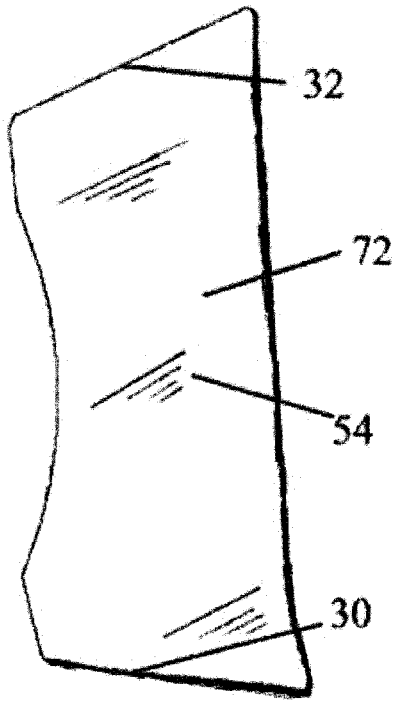
FIG. 6*a* depicts an example foot cover with receptacles, according to an example embodiment.
Figure 6B:
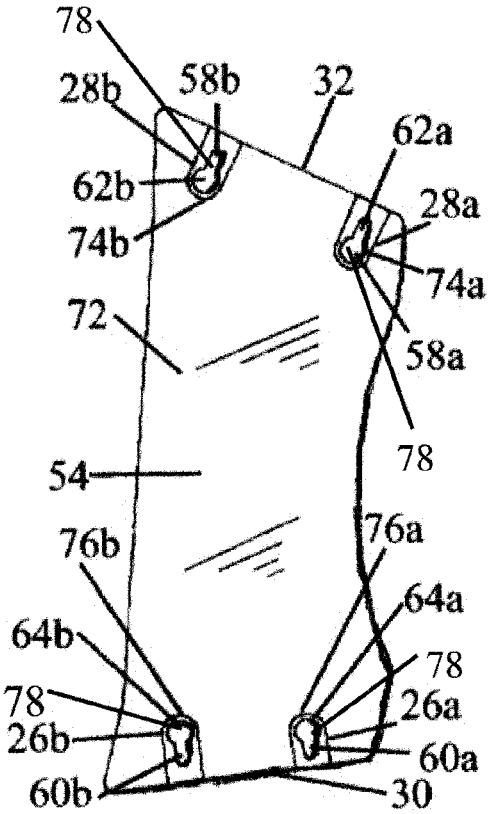
FIG. 6*b* depicts a bottom view of the foot cover of FIG. 6*a*, according to an example embodiment.
Figure 6C:
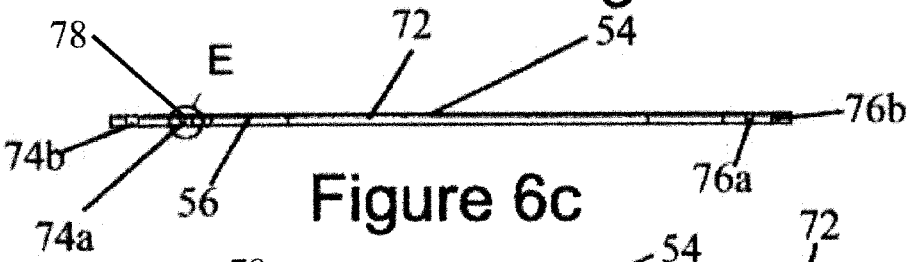
FIG. 6*c* depicts a side view of the foot cover of FIG. 6*a*, according to an example embodiment.
Figure 6D:
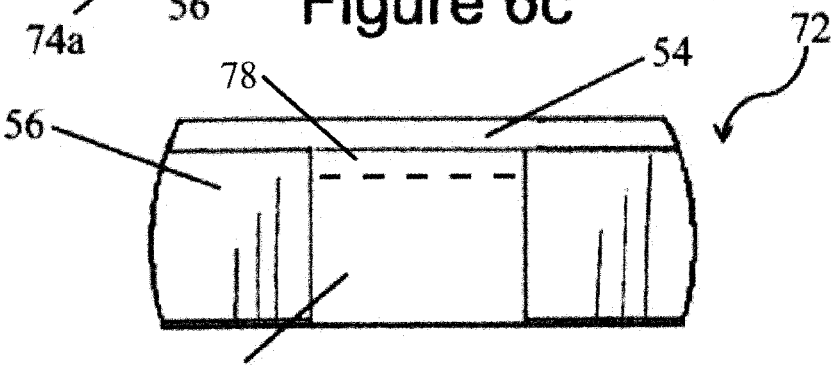
FIG. 6*d* depicts an enlarged view of the foot cover of FIG. 6*c*, according to an example embodiment.

Referring to FIG. 6*a* and FIG. 6*b*, an alternate embodiment of the foot cover 24 is generally designated 72. Components shared with the foot cover 24 and alternate foot cover 49 are designated with identical reference numbers. Important distinguishing features of the foot cover 72 include the presence of receptacles 74*a*, 74*b*, 76*a*, 76*b*. Specifically, the receptacles 74*a*, 74*b*, 76*a*, 76*b* have tapered openings 26*a*, 26*b*, 28*a*, 28*a* and cavities 62*a*, 62*b*, Ma, 64*b* defined by the recessed surfaces 58*a*, 58*b*, 60*a*, 60*b*, respectively, which also include sidewalls 66. The receptacles 74*a*, 74*b*, 76*a*, 76*b* fit within cutouts in the cushioning layer 56. Then, the receptacles 74*a*, 74*b*, 76*a*, 76*b* and the cushioning layer 56 are covered by the image layer 54. FIG. 6*c* depicts a side view of the alternate embodiment. Additionally, FIG. 6*d* shows an enlarged view of the receptacle 74*a*, within the cushioning layer 56, beneath the image layer 54. In this preferred embodiment, the receptacles 74*a*, 74*b*, 76*a*, include a ceiling 78 which encapsulates the cavities 62*a*, 62*b*, Ma, 64*b*, such that the walls 66, and the ceiling 78 form five of the six sides of the enclosure which makes up the receptacle 74*a*, 74*b*, 76*a*, 76*b*. Additionally, in this preferred embodiment, the recessed surfaces 58*a*, 58*b*, 60*a*, 60*b* with the tapered openings 26*a*, 26*b*, 28*a*, 28*b*, form the sixth side of the receptacles 74*a*, 74*b*, 76*a*, 76*b*. As the ceiling 78 is underneath the image layer 54, the receptacles 74*a*, 74*b*, 76*a*, 76*b* are not seen when the sandal 20 is assembled. But differently, in an embodiment, the receptacles 74*a*, 74*b*, 76*a*, 76*b*, are simply the cavities 62*a*, 62*b*, 64*a*, 64*b*, with the ceilings 78, which cover the one side which was exposed in the cavities 62*a*, 62*b*, 64*a*, 64*b*. Other shapes of the receptacles 74*a*, 74*b*, 76*a*, 76*b* are contemplated as are known in the art. Additionally, the sidewalls 66 may be either flat or curved, in forming the cavities 62*a*, 62*b*, 64*a*, 64*b*, and the receptacles 74*a*, 74*b*, 76*a*, 76*b*.

Figure 7A:
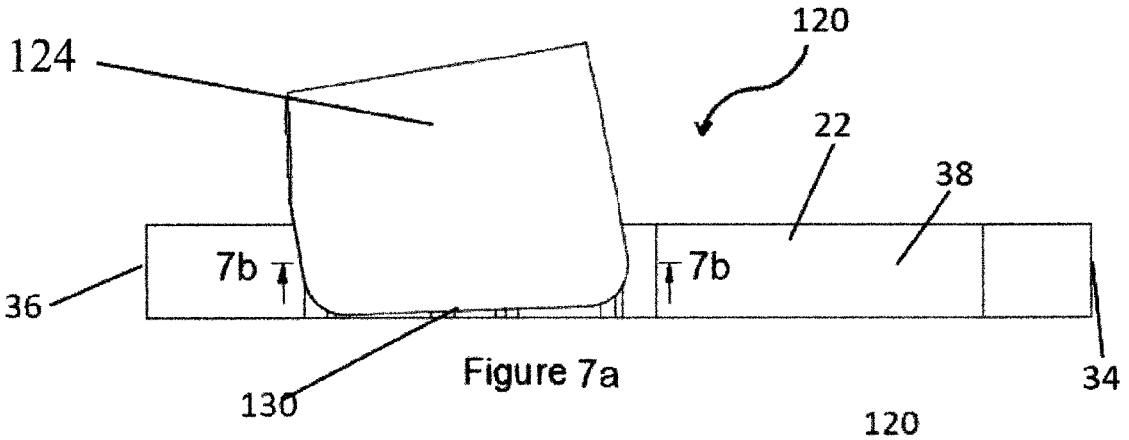
FIG. 7*a* depicts an example foot cover with base and cover attachments, according to an example embodiment.
Figure 7B:
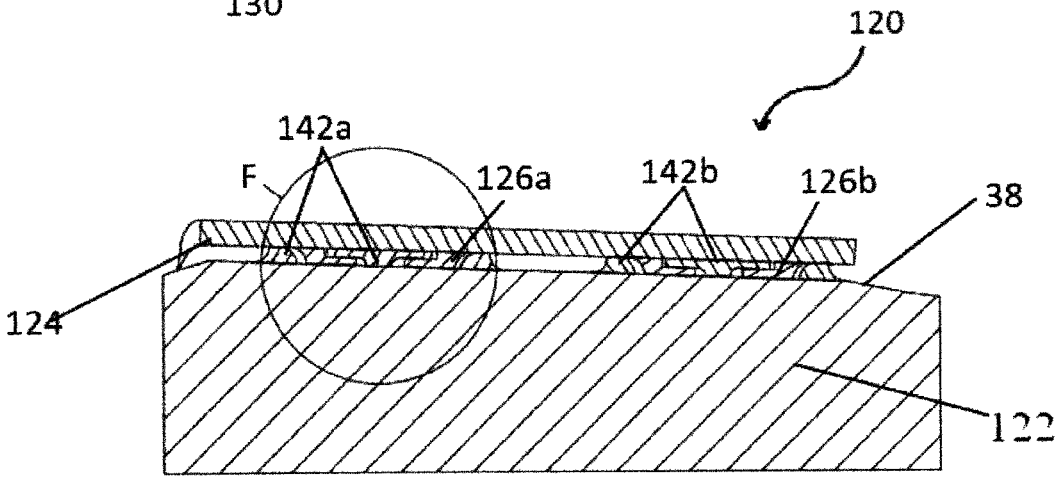
FIG. 7*b* is a cross-section taken along the line 7*b*-7*b* and in the direction generally indicted from arrows of FIG. 7*a*.
Figure 7C:
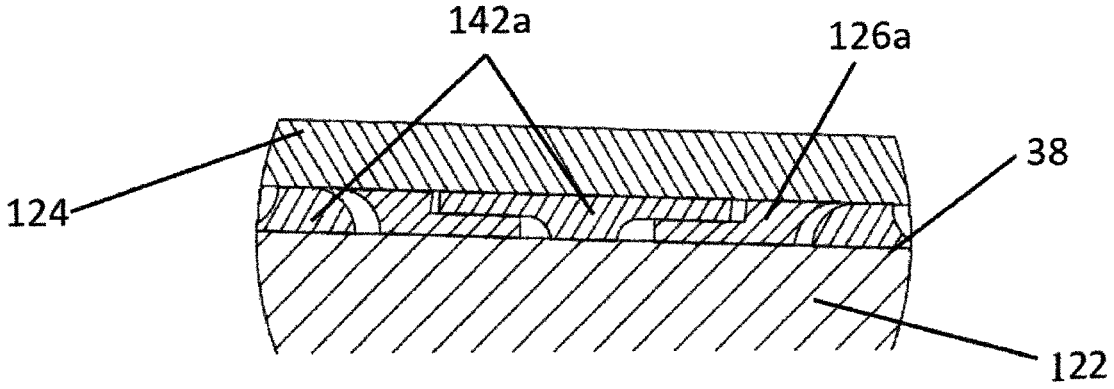
FIG. 7*c* depicts an enlarged base attachment and foot cover attachment of FIG. 7*b*, according to an example embodiment.

Referring to FIGS. 7*a*-7*c*, a second embodiment of a sandal or slide 120 has a base 122, and a foot cover 124 which is selectively removable from the base 122. Components shared by the sandal 20 are designated with identical reference numbers. FIG. 7*a* illustrates the assembled sandal 120, where the cover attachments 126*a*,126*b* and the base attachments 142*a*,142*b* are not visible. Specifically, the cover attachments 126*a*,126*b* and the base attachments 142*a*,142*b* are hidden behind the foot cover 124. The base 122 also has a toe portion 36, and a heal portion 34. FIG. 7*b* shows a cross sectional view of the sandal 120 taken along the line 7*b*-7*b* of FIG. 7*a*. In particular, the foot cover 124 includes cover attachments 126*a*,126*b* which interlock with the base attachments 142*a*,142*b* of the base 122. FIG. 7*c* is a close up view of the interlocked cover attachment 126*a* and base attachment 142*a*.

As with the base 22, the base 122 has peripheral sides 38, 40. The peripheral side 38 includes at least one base attachment, and in a particular embodiment, a pair of base attachments 142*a*,142*b*. Similarly, the peripheral side 40 includes at least one base attachment, and in a particular embodiment, a pair of base attachments 144*a*,144*b*. Referring to FIGS. 8*b*, 8*c*, 10*a*, and 10*b*, each base attachment 142*a*,142*b*,144*a*, 144*b* preferably has two arms 146 which are on opposing sides of the base attachment 142*a*,142*b*,144*a*,144*b*, as well as a shaft 150 extending from a central portion of the base attachment 142*a*,142*b*,144*a*,144*b*. The shaft 150 preferably includes two indents 152 within the shaft 150. The two indents 152 are preferably separated by a post 154. Further, the shaft 150 includes a front face 151, which engages a rear wall 157 of the cover attachment 126*a*,126*b*,128*a*,128*b*. However, other configurations of the base attachments 142*a*, 142*b*,144*a*,144*b* are contemplated as are known in the art.

Figure 9A:
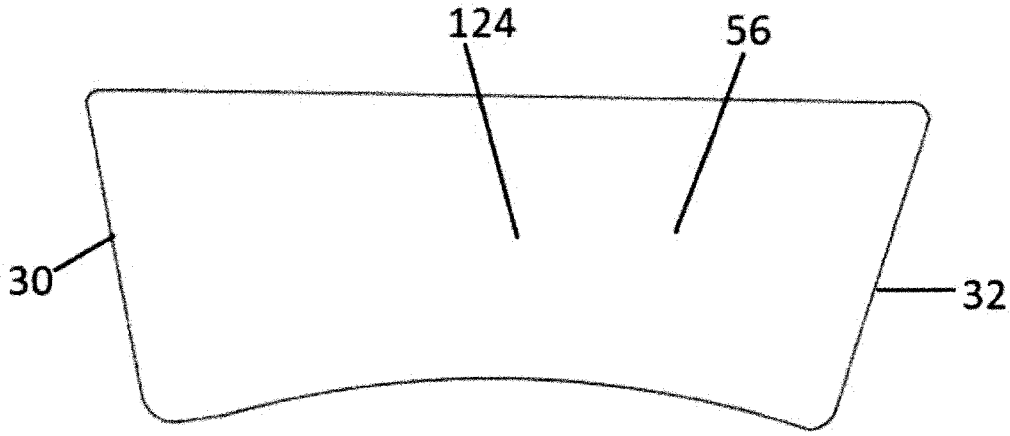
FIG. 9*a* depicts a top view of an example foot cover with cover attachments, according to an example embodiment.
Figure 9B:
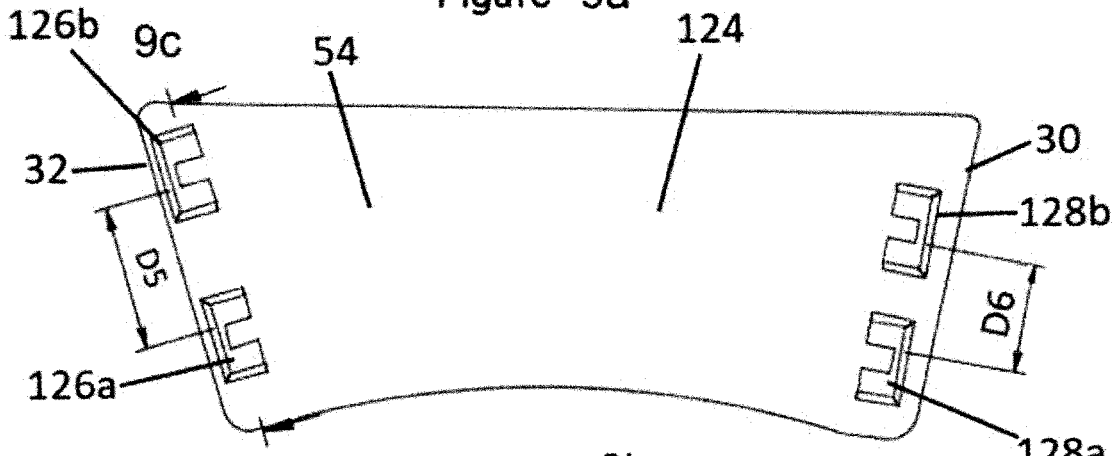
FIG. 9*b* depicts a bottom view of the cover FIG. 9*a*, according to an example embodiment.
Figure 9C:
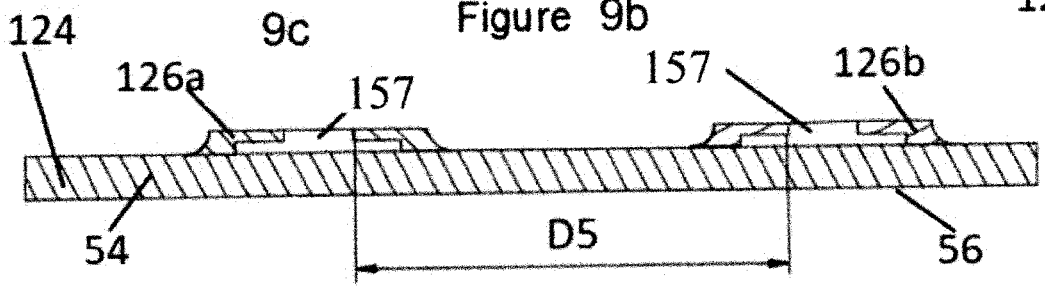
FIG. 9*c* is a cross-section taken along the line 9*c*-9*c* and in the direction generally indicted from arrows of FIG. 9*b*.

FIG. 9*a* displays the foot cover 124, which preferably includes an image layer 56. As shown in FIG. 9*b*, the foot cover 124 has a terminal edge 30 which includes at least one cover attachment, and in a particular embodiment, a pair of cover attachments 126*a*,126*b*. Similarly, a terminal edge 32 opposite the terminal edge 30 includes at least one cover attachment, and in a particular embodiment, a pair of cover attachments 128*a*,128*b*. FIG. 9*c* shows a cross section view of the foot cover of FIG. 9*b* taken along the line 9*c*-9*c*. Specifically, the foot cover 124 preferably includes a cushion layer 54 which is between the image layer 56 and the cover attachments 126*a*,126*b*. Also shown is the rear wall 157 of the cover attachments 126*a*,126*b*.

Figure 8A:
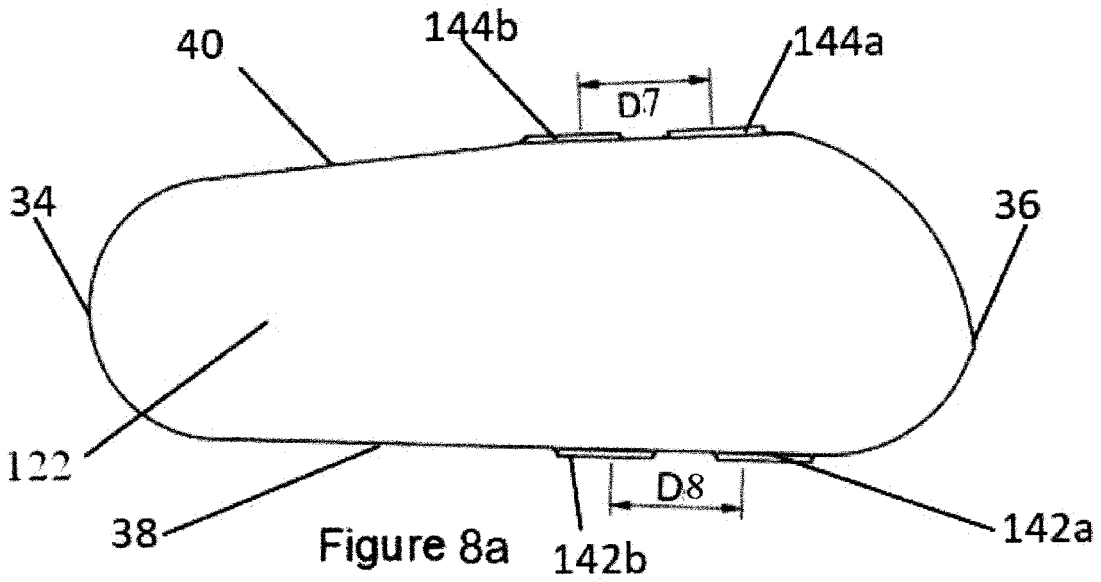
FIG. 8*a* depicts a base separate from a foot cover, according to an example embodiment.
Figure 8B:
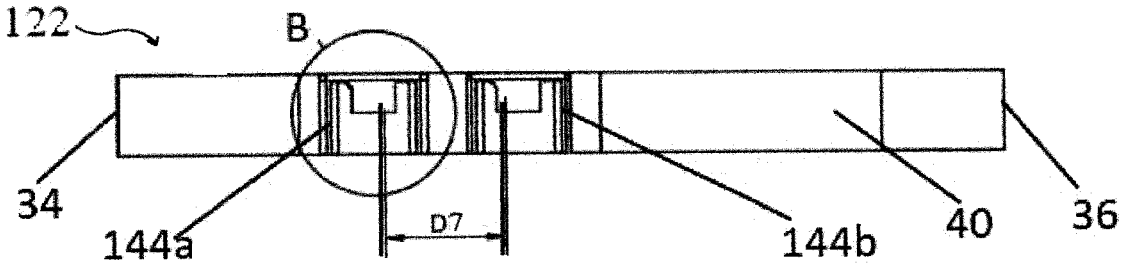
FIG. 8*b* depicts a side view of the base of FIG. 8*a*, according to an example embodiment.
Figure 8C:
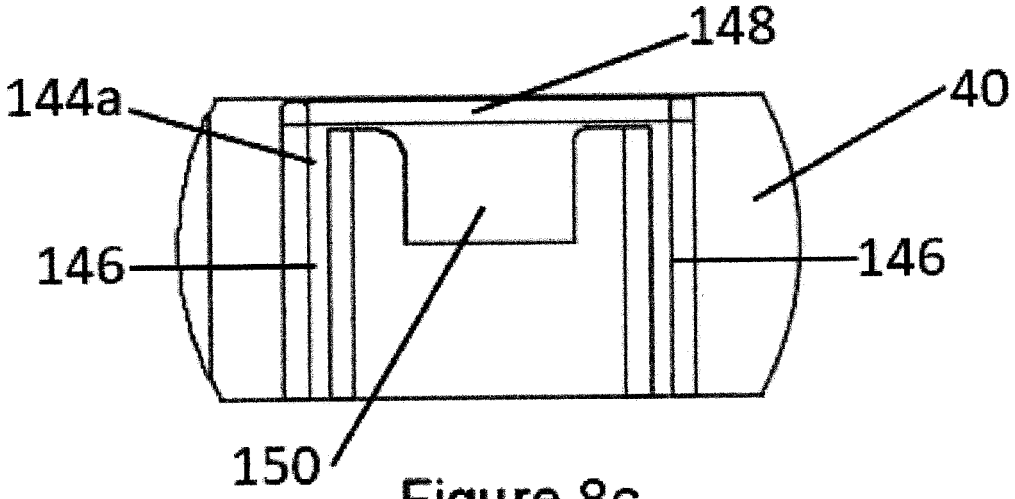
FIG. 8*c* depicts an enlarged base attachment of FIG. 8*b*, according to an example embodiment.

FIG. 8*a* shows the base 122, with a distance D7 defined between the base attachments 142*a*,142*b*, and a distance D8 defined between the base attachments 144*a*,144*b*. Moreover, FIG. 9*b* shows the cover 124, with a distance D5 defined between cover attachments 126*a*,126*b* and a distance D6 defined between cover attachments 128*a*,128*b*. D7 is preferably equal to D5 so that the base attachments 142*a*,142*b* are engaged with the respective covered attachments 126*a*, 126*b*. Similarly, D8 is preferably equal to D6, so that the base attachments 144*a*,144*b* are engaged with the respective cover attachments 128*a*,128*b*. The base 122 is preferably made of a flexible PVC or rubber-like material, or other suitable material known to those in the art.

Figure 10A:
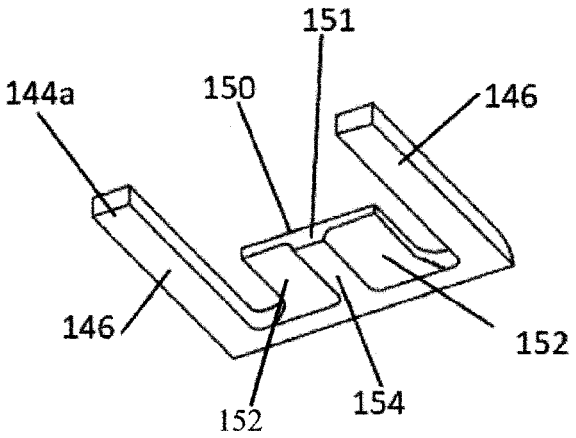
FIG. 10*a* depicts a bottom perspective view of the base attachment, according to an example embodiment.
Figure 10B:
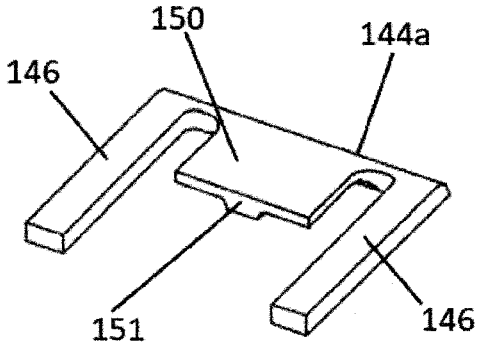
FIG. 10*b* depicts a top perspective view of the base attachment, according to an example embodiment.
Figure 10C:
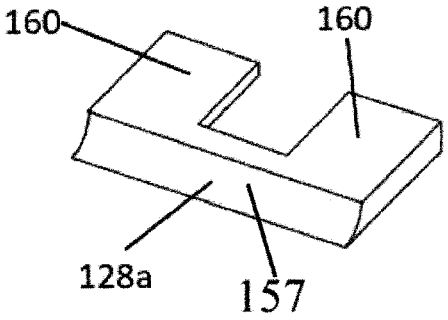
FIG. 10*c* depicts a bottom perspective view of the cover attachment, according to an example embodiment
Figure 10D:
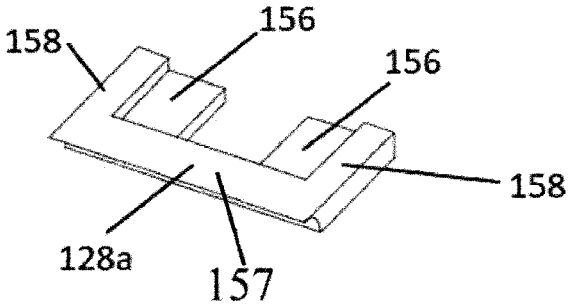
FIG. 10*d* depicts a top perspective view of the cover attachment, according to an example embodiment.

Referring now to FIGS. 10*c* and 10*d*, the cover attachment 128*a* includes legs 158 on opposing sides of the cover attachment 128*a*. Connected to, and extending from, the legs 158 are tabs 156, which engage the indents 152 from the base attachment 144*a*. The cover attachment 128*a* also has top surfaces 160, which are visible when the cover 124 is disassembled. As seen in FIG. 9*c*, the cover attachment 126*a* also includes a rear wall 157. The rear wall 157 engages the front face 151 of the shaft 150, thereby forming a secure connection. As the foot of the wearer pushes against the bottom surface of the foot cover 124, the front face 151 presses against the rear wall 157, and the tabs 156 engage the indents 152. These engagements help provide a reliable connection.

Figure 11A:
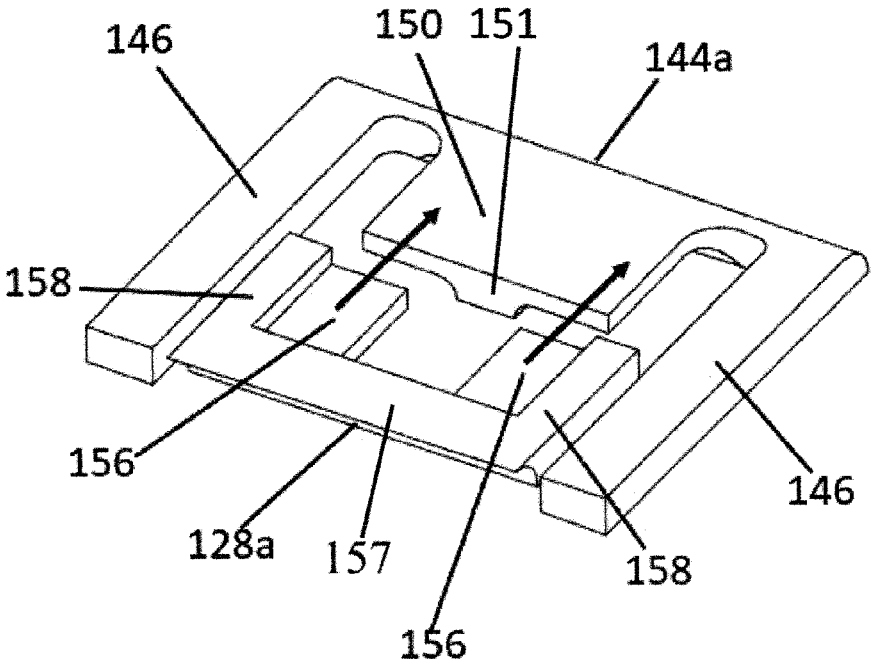
FIG. 11*a* depicts an example affixation of the base attachment to the cover attachment, according to an example embodiment.
Figure 11B:
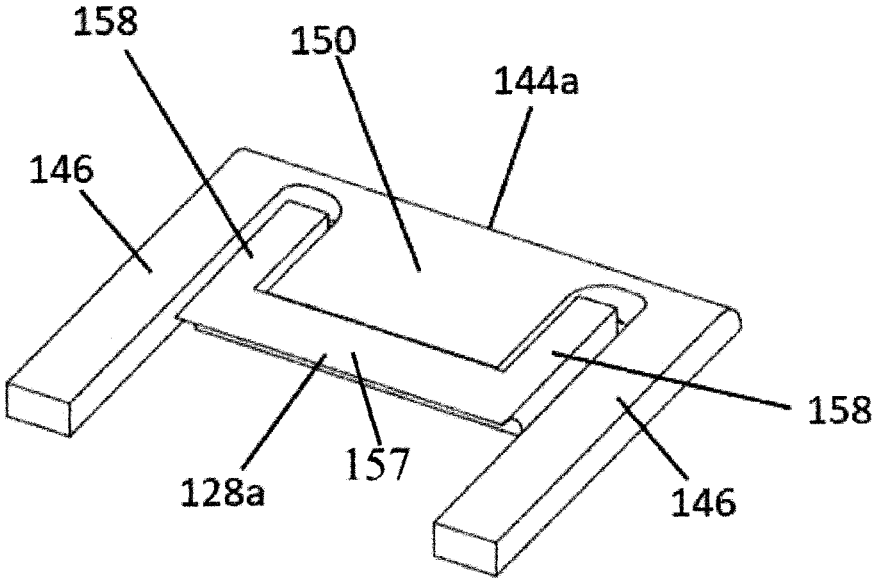
FIG. 11*b* depicts the affixed base and cover attachments of FIG. 11*a*, according to an example embodiment.

FIGS. 11*a* and 11*b* illustrate process of assembling the base attachment 144*a* and the cover attachment 128*a*. The arrows on FIG. 11*a* indicate the direction of motion of the cover attachment 128*a* relative to the base attachment 144*a*. The cover attachment 128*a* is placed between the arms 146 of the base attachment 144*a*. Then, the cover attachment 128*a* is moved in the direction indicated by the arrows so that the tabs 156 engage the indents 152, and the rear wall 157 is in contact with the front face 151 of the shaft 150. These points of contact provide a secure and easy to assembly connection. FIG. 11*b* illustrates the cover attachment 128*a*, and the base attachment 144*a* when they are assembled.

Figure 12A:
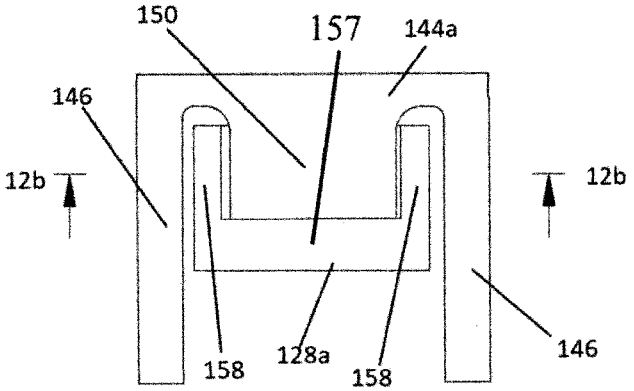
FIG. 12*a* depicts a top view of the affixed base and cover attachments of FIG. 11*b*, according to an example embodiment.
Figure 12B:
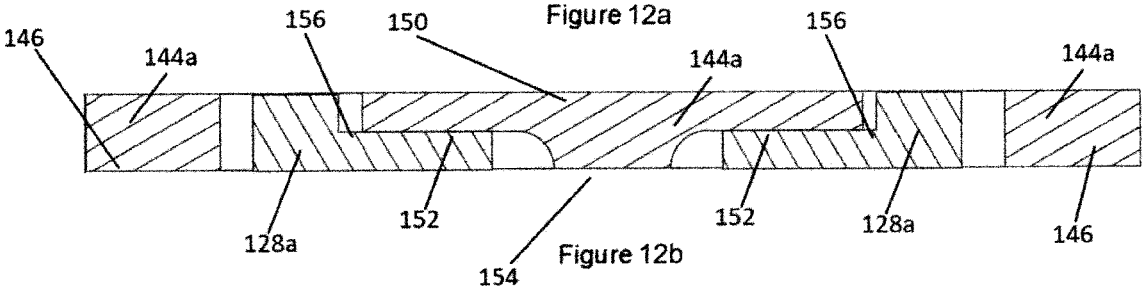
FIG. 12*b* is a cross-section taken along the line 12*b*-12*b* and in the direction generally indicted from arrows of FIG. 12*a*.

FIG. 12*a* also illustrates an assembled cover attachment 128*a* and base attachment 144*a*. FIG. 12*b* is a cross section view of the assembled base attachment 144*a* and the cover attachment 128*a* taken along the line 12*b*-12*b*. This further illustrates the engagement between the tabs 156 and the indents 152.

Figure 13B:
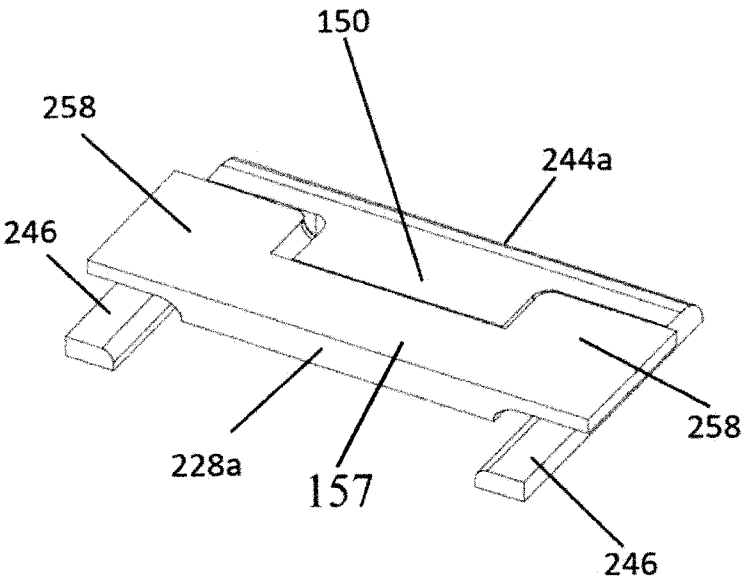
FIG. 13*b* depicts the affixed alternate base and cover attachments of FIG. 13*a*, according to an example embodiment.
Figure 13A:
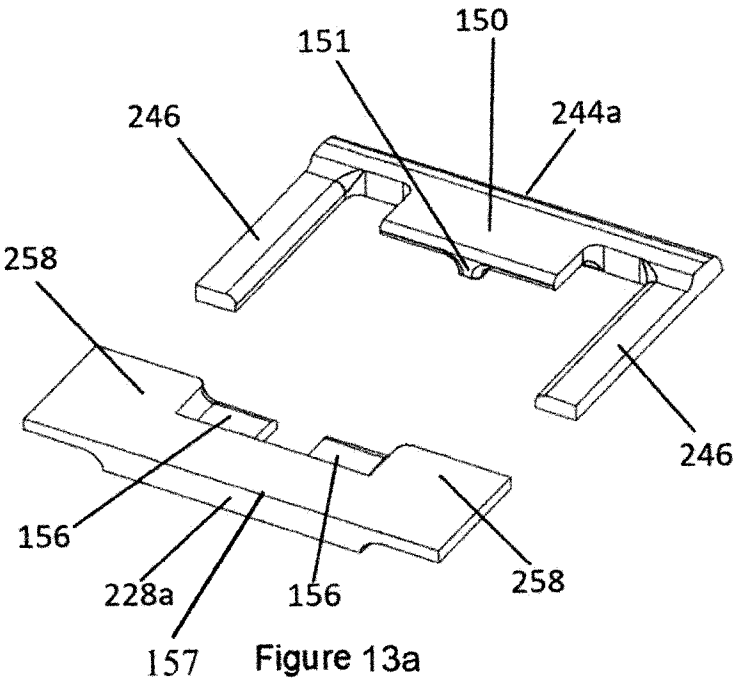
FIG. 13*a* depicts a perspective view of an alternate cover attachment and alternate base attachment, according to an example embodiment

FIGS. 13*a* and 13*b* illustrate an alternate cover attachment 228*a* and base attachment 244*a*. Components shared with the base attachment 128*a* and cover attachment 144*a* are designated with identical reference numbers. The alternate cover attachment 228*a* has extended legs 258, that provide additional surface area for attachment to the foot cover 124. Each of the remaining features of the alternate cover attachment 228*a* are identical to cover attachment 128*a*. In a similar manner, the alternate base attachment 244*a* has arms 246 which have depressions along their length. These depressions are intended to accommodate the extended legs 258 of the alternate cover attachment 228*a*. The remaining features of the alternate base attachment 244*a* are identical to the base attachment 144*a*.

The base attachments 142*a*,142*b*,144*a*,144*b* and the cover attachments 126*a*,126*b*,128*a*,128*b* are preferably made of hard plastic, epoxy resin, or other suitable material known to those in the art. Further, the cushioning layer 54 is preferably made of a durable, flexible material that is more soft and flexible than the base attachments 142*a*,142*b*,144*a*,144*b* or cover attachments 126*a*,126*b*,128*a*,128*b*. Finally, the image layer 56, is made of a material, such as, but not limited to, synthetic paper with laser printing, or sublimation used on materials compatible with sublimation, to allow unique designs and logos to be transferred onto the top of the foot cover 124. Contemplated are other materials and methods for creating the alternate foot cover 124 as are known in the art. Also contemplated is a foot cover 124 which is transparent and has no image layer 56 and has only a transparent cushioning layer 70, and cover attachments 126*a*,126*b*, 128*a*,128*b*.

It is contemplated that the pair of base attachments and the pair of cover attachments may be attached to form a unitary piece. For example, the cover attachments 126*a*,126*b* may be connected such that the cover attachments 126*a*,126*b* are formed on a single component. Likewise, the cover attachments 128*a*,128*b* may be formed from a single component. Further, the pair of base attachments 142*a*,142*b* may be formed on a single attached piece. Likewise, the cover attachments 144*a*,144*b* may be formed on a single attached piece. Also contemplated are base attachments 142*a*,142*b*, 144*a*,144*b* which are integral with the base 122, and cover attachments 126*a*,126*b*,128*a*,128*b* which are integral with the cover 124.

The manufacturing process for the present sandal or slide 20, as illustrated by FIGS. 5*a*-5*d*, preferably begins with receiving the image or design to be displayed on the detachable foot cover 24. Using an image transfer method, such as, but not limited to, a laser printer with synthetic paper or sublimation, the image is placed on the image layer 56. Then, the image layer 56 is attached to the cushioning layer 54 with an attachment process such as, but not limited to, adhesive or stitching. Once the cushioning layer 54 and the image layer 56 are attached, the two are cut to the correct shape. In an example embodiment, the end caps 50, 52, which cover the terminal edges 30, 32, are attached to the cushioning layer 54 and the image layer 56. Alternatively, referring to FIGS. 6*a*-6*d*, the receptacles 74*a*, 74*b*, 76*a*, 76*b* are attached to the cushioning layer 56. Then the receptacles 74*a*, 74*b*, 76*a*, 76*b* and the cushioning layer 54 are attached to the image layer 56. Various forms of attachment are contemplated as are known in the art. In one embodiment, the base 22 is made by inserting the pins 42*a*, 42*b*, 44*a*, 44*b* into the base 22 at the necessary location so that preferably, the tapered openings 26*a*, 26*b*, 28*a*, 28*b* line up properly with the pins 42*a*, 42*b*, 44*a*, 44*b*. Alternatively, the pins 42*a*, 42*b*, 44*a*, 44*b* are attached to the base 22 with an attachment process such as, but not limited to, adhesive. Additional methods for attaching the pins 42*a*, 42*b*, 44*a*, 44*b* to the base 22 are contemplated as are known in the art.

The manufacturing process for the second embodiment of the present sandal or slide 120, as illustrated by FIGS. 8*a*-9*c*, preferably begins with receiving the image or design to be displayed on the detachable foot cover 124. Using an image transfer method, such as, but not limited to, a laser printer with synthetic paper or sublimation, the image is placed on the image layer 56. Then, the image layer 56 is attached to the cushioning layer 54 with an attachment process such as, but not limited to, adhesive or stitching. Once the cushioning layer 54 and the image layer 56 are attached, the two are cut to the correct shape. In an example embodiment, the cover attachments 126*a*,126*b*,128*a*,128*b* are attached to the cushioning layer 54 of the detachable foot cover 124. Preferably, the cover attachments 126*a*,126*b*,128*a*,128*b* are attached to the foot cover using either an adhesive, or other suitable attachment means. Various forms of attachment for the cover attachments 126*a*,126*b*,128*a*,128*b* to the foot cover 124 are contemplated as are known in the art. Alternatively, for embodiments where the cover attachments 126*a*,126*b* are formed on a single piece, that piece may be attached to the cushioning layer 54. Similarly, when a single piece has the cover attachments 128*a*,128*b* may be similarly attached to the cushioning layer 54. In a similar fashion, the base 122 is made by attaching the base attachments 142*a*,142*b*,144*a*, 144*b* to the base 22 at the necessary location so that preferably, the cover attachments 126*a*,126*b*,128*a*,128*b* line up properly with the base attachments 142*a*,142*b*,144*a*, 144*b*. Alternatively, the base attachments 142*a*,142*b*,144*a*, 144*b* are attached to the base 122 with an attachment process such as, but not limited to, adhesive. Additional methods for attaching the base attachments 142*a*,142*b*,144*a*,144*b* to the base 122 are contemplated as are known in the art. Alternatively, for embodiments where the base attachments 142*a*, 142*b* are formed on a single piece, that piece may be attached to the base 122. The single piece which has the cover attachments 144*a*,144*b* may be similarly attached to the base 122.

Numerous modifications will be apparent to those skilled in the art in view of the foregoing description. Accordingly, this description is to be construed as illustrative only and is presented for the purpose of enabling those skilled in the art to make and use what is herein disclosed and to teach the best mode of carrying out same. The exclusive rights to all modifications which come within the scope of this disclosure are reserved.

The invention claimed is:

1. A sandal, comprising:

a base, comprising:

a top surface upon which a human foot rests;

a periphery defining a peripheral heel end, a peripheral toe end, a longitudinal extent measured from said heel end to said toe end, and first and second opposed peripheral sides, said first peripheral side having at least one base attachment and said second peripheral side having at least one base attachment, wherein said at least one base attachment comprises:

a rear portion which extends along the width of said base attachment:

two arms which extend substantially perpendicularly to said rear portion, wherein the arms form opposed sides of said base attachment: and a shaft extending from a central region of said rear portion, said shaft including a front face which contacts a rear wall of said cover attachments, wherein said shaft further inludes two indents separated by a post; and a foot cover which includes a planar surface with a first terminal edge and a second terminal edge, selectively detachable from said base, comprising:

at least one cover attachment which receives said at least one base attachment on said first peripheral side; and at least one cover attachment which receives said at least one base attachment on said second peripheral side.

2. The sandal of claim 1, wherein said first peripheral side comprises a pair of said base attachments and said second peripheral side comprises a pair of said base attachments.

3. The sandal of claim 2, wherein the pair of said base attachments on said first peripheral side define a first distance therebetween, and wherein the pair of said base attachments on said second peripheral side define a second distance therebetween and wherein said first distance is different from said second distance.

4. The sandal of claim 2, wherein one of the pair of said base attachments on said first peripheral side is spaced a greater distance from the top surface of said base than the other of the pair of said base attachments on said first peripheral side.

5. The sandal of claim 1, wherein said foot cover further comprises a first layer and a second layer, wherein said second layer comprises a cushioning material and said first layer comprises an image layer, said image layer being exterior to said cushioning layer.

6. The sandal of claim 1, wherein a body of said foot cover is transparent.

7. The sandal of claim 1, wherein said at least one cover attachment comprises:

a rear wall which runs substantially parallel to said first or second terminal edge;

two legs extending substantially perpendicularly from said rear wall on opposing lateral sides of said cover attachment; and two tabs extending from said cover attachment and said rear wall, wherein said tabs are not in contact with said foot cover.

8. The sandal of claim 7, wherein said tabs are substantially perpendicular to said rear wall, and said at least one cover attachment further comprises an opening coplanar with said tabs such that said opening is defined by inner opposed edges of said tabs.

9. The sandal of claim 4, wherein each of said pair of base attachments has arms, wherein further one of the base attachments has arms which extend further than the other of said pair of base attachments.

10. The sandal of claim 1, wherein said foot cover further comprises a pair of said cover attachments on said first terminal edge which define a first distance therebetween, and a pair of said cover attachments on said second terminal edge which define a second distance therebetween and wherein said first distance is different from said second distance.

11. The sandal of claim 2, wherein said pair of base attachments are configured as a single component.

12. The sandal of claim 10, wherein said pair of cover attachments are configured as a single component.

13. A selectively detachable foot cover for sandals which includes a planar surface with a first terminal edge and a second terminal edge, comprising:

a body;

a main planar surface of said body extending between said first and second terminal edges;

at least one cover attachment defined proximate said first terminal edge; and at least one cover attachment defined proximate said second terminal edge, wherein said at least one cover attachment comprises:

a rear wall which runs substantially parallel to said first or second terminal edge:

two legs extending substantially perpendicularly from said rear wall on opposing lateral sides of said cover attatchment; and two tabs extending from said cover attachment and said rear wall, wherein said tabs are substantially perpendicular to said rear wall, and said tabs are not in contact with said foot cover.

14. The foot cover of claim 13, further comprising a pair of said cover attachments proximate said first terminal edge and a pair of said cover attachments proximate said second terminal edge.

15. The foot cover of claim 14, wherein the pair of said cover attachments proximate said first terminal edge defines a first distance therebetween, and wherein the pair of said cover attachments proximate said second terminal edge define a second distance therebetween and wherein said first distance is different from said second distance.

16. The foot cover of claim 14, wherein one of the pair of said cover attachments proximate said first terminal edge is spaced a greater distance from said first terminal edge than the other of the pair of said cover attachments proximate said first terminal edge.

17. The foot cover of claim 13, wherein said foot cover comprises first and second layers, wherein said second layer comprises a cushioning material and said first layer comprises an image layer, such that said first layer is exterior to said second layer.

18. The sandal of claim 13, wherein said at least one cover attachment further comprises:

an opening coplanar with said tabs such that said opening is defined by inner opposed edges of said tabs.

19. A sandal, comprising:

a base, comprising:

a top surface upon which a human foot rests;

a periphery defining a peripheral heel end, a peripheral toe end, a longitudinal extent measured from said heel end to said toe end, and first and second opposed peripheral sides, said first peripheral side having at least one base attachment and said second peripheral side having at least one base attachment; and a foot cover which includes a planar surface with a first terminal edge and a second terminal edge, selectively detachable from said base, comprising:

at least one cover attachment which receives said at least one base attachment on said first peripheral side; and at least one cover attachment which receives said at least one base attachment on said second peripheral side, wherein said at least one cover attachment comprises:

a rear wall which runs substantially parallel to said first or second terminal edge;

two legs extending substantially perpendicularly from said rear wall on opposing lateral sides of said cover attachment; and two tabs extending from said cover attachment and said rear wall, wherein said tabs are substantially perpendicular to said rear wall, and said tabs are not in contact with said foot cover.

20. The sandal of claim 19 wherein said at least one cover attachment further comprises:

an opening coplanar with said tabs such that said opening is defined by inner opposed edges of said tabs.

* * * * *